US009002236B2

(12) United States Patent
Uyama

(10) Patent No.: US 9,002,236 B2
(45) Date of Patent: Apr. 7, 2015

(54) CLEANING DEVICE FOR REMOVING A DEVELOPER FROM THE SURFACE OF AN IMAGE BEARING MEMBER AND PROCESS CARTRIDGE

(71) Applicant: Canon Kabushiki Kaisha, Tokyo (JP)

(72) Inventor: Masao Uyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 31 days.

(21) Appl. No.: 13/658,959

(22) Filed: Oct. 24, 2012

(65) Prior Publication Data

US 2013/0108321 A1 May 2, 2013

(30) Foreign Application Priority Data

Oct. 28, 2011 (JP) ..... 2011-237520
Sep. 3, 2012 (JP) ..... 2012-193265

(51) Int. Cl.
*G03G 21/00* (2006.01)
*G03G 21/12* (2006.01)

(52) U.S. Cl.
CPC ..... *G03G 21/12* (2013.01); *G03G 21/0029* (2013.01)

(58) Field of Classification Search
CPC ..... G03G 21/169; G03G 15/00; G03G 15/20; G03G 21/00; G03G 21/0029
USPC ..... 399/123, 343, 346, 347, 351, 358, 350, 399/384
See application file for complete search history.

(56) References Cited

U.S. PATENT DOCUMENTS

| | | | | |
|---|---|---|---|---|
| 4,498,760 | A * | 2/1985 | Sugiyama | 399/351 |
| 7,065,317 | B2 * | 6/2006 | Suda | 399/350 |
| 7,158,749 | B2 * | 1/2007 | Ueno et al. | 399/351 |
| 8,244,156 | B2 * | 8/2012 | Iwamoto et al. | 399/123 |
| 2014/0037323 | A1 * | 2/2014 | Oka | 399/102 |
| 2014/0153990 | A1 * | 6/2014 | Oka et al. | 399/351 |

FOREIGN PATENT DOCUMENTS

| | | | |
|---|---|---|---|
| JP | 1-235987 | A | 9/1989 |
| JP | 4-172486 | A | 6/1992 |
| JP | 06-095502 | A | 4/1994 |
| JP | 6-186890 | A | 7/1994 |
| JP | 07-306621 | A | 11/1995 |
| JP | 2002-214886 | A | 7/2002 |
| JP | 2006-259394 | A | 9/2006 |
| JP | 2007-017914 | A | 1/2007 |

* cited by examiner

*Primary Examiner* — G. M. Hyder
(74) *Attorney, Agent, or Firm* — Canon USA, Inc., IP Division

(57) ABSTRACT

A cleaning device, which is detachably attached to a main body of an image forming apparatus, includes a fixing portion provided at a frame member, a cleaning member fixed to the fixing portion for removing a developer from an image bearing member, the cleaning member including a blade portion configured to contact the image bearing member and a flexible support member for supporting the blade portion, a container formed by the frame member and configured to contain the developer removed from the image bearing member, and a restricting member configured to engage with the support member and being capable of restricting the support member from being deformed.

20 Claims, 7 Drawing Sheets

CLEANING DEVICE FOR REMOVING A DEVELOPER FROM THE SURFACE OF AN IMAGE BEARING MEMBER AND PROCESS CARTRIDGE

BACKGROUND OF THE INVENTION

1. Field of the Invention

The present invention relates to a cleaning device capable of removing a developer from a surface of an image bearing member, and to a process cartridge including the cleaning device, which are provided in an electrophotographic image forming apparatus such as a printer, a copying machine, and a facsimile apparatus.

2. Description of the Related Art

An image forming apparatus, such as a laser beam printer and a copying machine, employing the electrophotographic method first forms an electrostatic latent image by irradiating an evenly charged electrophotographic photosensitive member with light (for example, laser light) corresponding to image information. After that, the image forming apparatus supplies a developer (toner) to the electrostatic latent image by a development unit to visualize the electrostatic latent image as a developed image (a toner image), and then transfers the image from the photosensitive member to a recording material, such as paper, thereby forming an image on the recording material and outputting it.

According to a widely adopted configuration, the developer remaining on the photosensitive member without being transferred is removed by a cleaning member, which is disposed to contact the photosensitive member. In a generally well-known configuration, the cleaning member is configured to include a support member constituted by a rigid sheet metal and a blade portion disposed at the tip of the support member. The blade portion is made of, for example, a urethane rubber, and is configured to contact the photosensitive member.

A known problem with the above-described configuration is that a contact state of the cleaning member is changed in the longitudinal direction due to how the cleaning member is installed in a container or how the cleaning member is configured. For solving this problem, Japanese Patent Application Laid-Open No. 01-235987 and Japanese Patent Application Laid-Open No. 06-186890 discuss a configuration in which a deformation amount of the blade portion varies in the longitudinal direction when the blade portion contacts the photosensitive member. Japanese Patent Application Laid-Open No. 2006-259394 discusses a configuration in which a free length of the blade portion varies.

Further, Japanese Patent Application Laid-Open No. 04-172486 discusses a configuration in which the support member is constituted by a flexible plate spring, and a rubber such as urethane is provided at the tip of the plate spring, as a measure for further stabilizing a contact pressure applied from the blade portion to the photosensitive member. In this configuration, not only the blade portion is deformed, but also the plate spring is deformed accordingly, thereby stabilizing the contact pressure applied to the photosensitive member.

If the cleaning member includes a rubber portion, at the tip thereof, which contacts a photosensitive member, and the rubber portion is supported by a plate spring member, the support member is less rigid than the support member constituted by a sheet metal since the plate spring member itself is elastic.

Therefore, when the cleaning device or the process cartridge is detached from the main body of the image forming apparatus, the plate spring member may be plastically deformed by receiving a vibration or an impact. In this case, the blade portion cannot contact the photosensitive member at a predetermined pressure, so that it may become impossible to sufficiently remove the developer remaining on the photosensitive member. Further, the developer may leak from the cleaning device.

SUMMARY OF THE INVENTION

The present invention is directed to a cleaning device detachably attached to a main body of an image forming apparatus, which is capable of sufficiently removing a developer remaining on a photosensitive member and of preventing the developer from leaking from the cleaning device.

According to an aspect of the present invention, a cleaning device, which is detachably attached to a main body of an image forming apparatus, includes a fixing portion provided at a frame member, and a cleaning member fixed to the fixing portion for removing a developer from an image bearing member, the cleaning member including a blade portion configured to contact the image bearing member and a flexible support member for supporting the blade portion, a container formed by the frame member and configured to contain the developer removed from the image bearing member, and a restricting member configured to engage with the support member and being capable of restricting the support member from being deformed.

According to another aspect of the present invention, a process cartridge, which is detachably attached to a main body of an image forming apparatus, includes an image bearing member, a fixing portion provided at a frame member, a cleaning member fixed to the fixing portion for removing a developer from the image bearing member, the cleaning member including a blade portion configured to contact the image bearing member and a flexible support member for supporting the blade portion, a container formed by the frame member and configured to contain the developer removed from the image bearing member, and a restricting member configured to engage with the support member and being capable of restricting the support member from being deformed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 6:
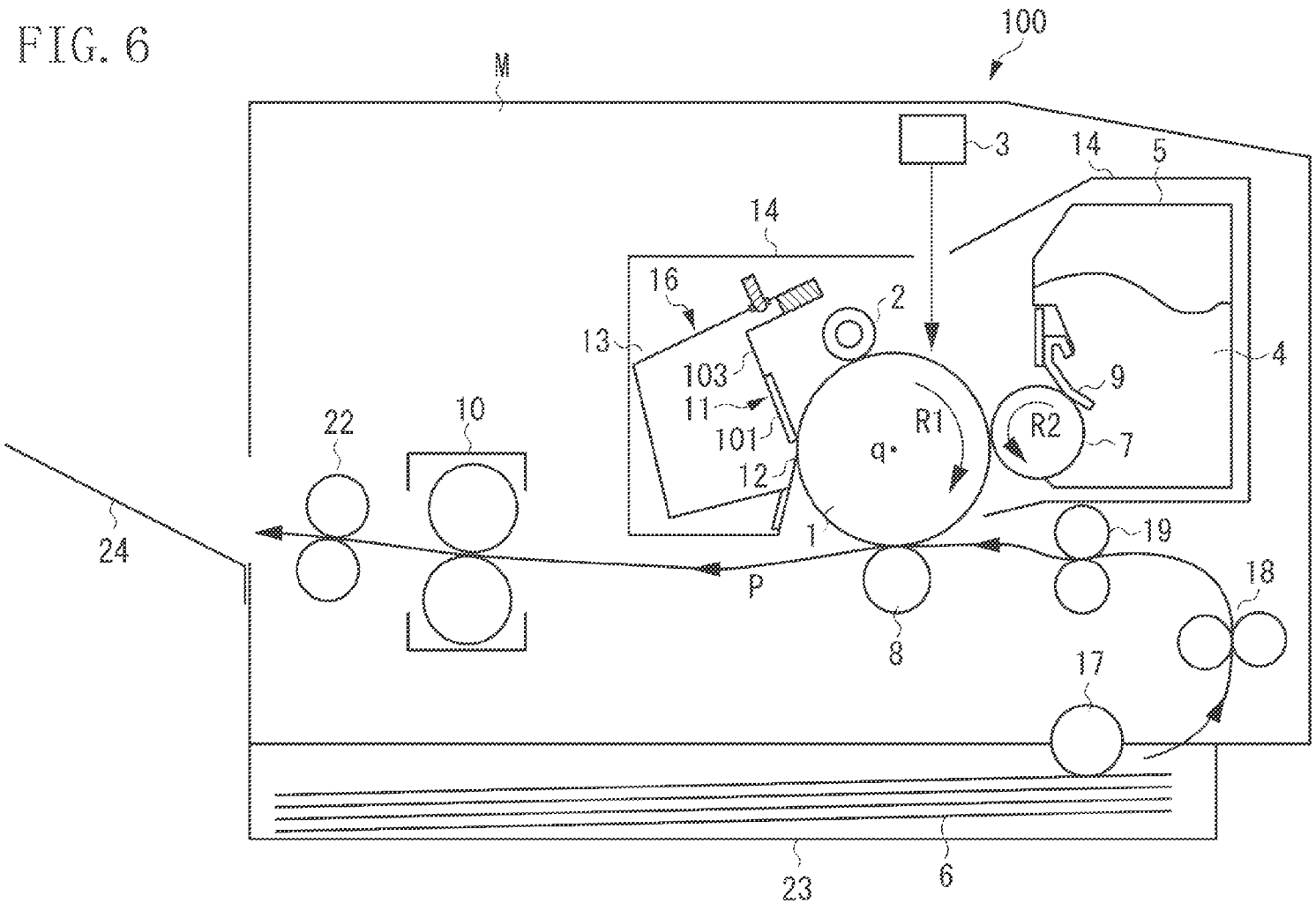
FIG. 6 schematically illustrates a configuration of an image forming apparatus according to the first exemplary embodiment of the present invention.

Hereinafter, an example of an image forming apparatus according to a first exemplary embodiment will be described. FIG. 6 is a vertical cross-sectional view illustrating an electrophotographic image forming apparatus 100.

The image forming apparatus 100 includes a drum-type photosensitive drum 1 as an image bearing member (a member to be charged). The photosensitive drum 1 includes an optical photo conductor (OPC) photosensitive layer, which is formed on the outer circumferential surface of a drum base made of conductive material, such as aluminum. The photosensitive drum 1 has an outer diameter of ϕ24 mm, and is driven to rotate around a shaft center q at a predetermined process speed (a circumferential speed) of 200 mm/s in the direction indicated by the arrow R1.

The surface (the circumferential surface) of the above-described photosensitive drum 1 is evenly (uniformly) charged so as to have a predetermined polarity and potential by a charging roller 2 as a charging unit, which will be described below. The surface of the charged photosensitive drum 1 receives scanning and exposure of a laser beam output from a scanner 3 as an exposure unit, which is modulated according to a time-sequential electric digital pixel signal of target image information. Then, an electrostatic latent image corresponding to the target image information is formed on the surface of the photosensitive drum 1.

Then, toner 4 in a developing device 5 as a developing unit is attached to the electrostatic latent image by a developing roller 7 disposed in the developing device 5, whereby the electrostatic latent image is developed into a toner image. Further, a developing blade 9 regulates the layer thickness of the toner 4 borne on the circumferential surface of the developing roller 7.

On the other hand, a recording material 6 is fed from a cassette 23 by a sheet feeding roller 17. Then, the recording material 6 is transmitted to a transfer nip portion between the photosensitive drum 1 and a transfer roller 8 by conveyance roller pairs 18 and 19 in synchronization with the toner image written on the photosensitive drum 1. Then, a transfer bias for a transfer is applied from a transfer bias application power source to the transfer roller 8, whereby the toner image formed on the surface of the photosensitive drum 1 is transferred to the recording material 6.

The recording material 6 with the toner image transferred thereon is separated from the surface of the photosensitive drum 1, and is conveyed to a fixing device 10 as a fixing unit, where the toner image is fixed on the surface of the recording material 6. After that, the recording material 6 is discharged by a sheet discharge roller pair 22 to a sheet discharge tray disposed at an image forming apparatus main body (hereinafter referred to as "apparatus main body") M of the image forming apparatus 100.

On the other hand, the toner (the developer) remaining on the surface of the photosensitive drum 1 without being transferred to the recording material 6 is removed from the photosensitive drum 1, after the transfer, by a cleaning member 11 as a cleaning unit, and is contained in a cleaning container (a container) 13, which is formed by a frame member.

In the present exemplary embodiment, the four process devices, i.e., the photosensitive drum 1, the charging roller 2, the developing device 5, and a cleaning device 16 are integrally assembled to form a process cartridge 14 detachably attached to the apparatus main body M.

As illustrated in FIG. 6, the cleaning device 16 includes the cleaning member 11, a scooping sheet 12, and the cleaning container 13. The cleaning member 11 contacts the surface of the photosensitive drum 1, and serves to scrape off the remaining toner. The scooping sheet 12 is located below the cleaning member 11 to scoop off the toner removed by the cleaning member 11. The cleaning container 13 serves to contain the removed waste toner.

Figure 1A:
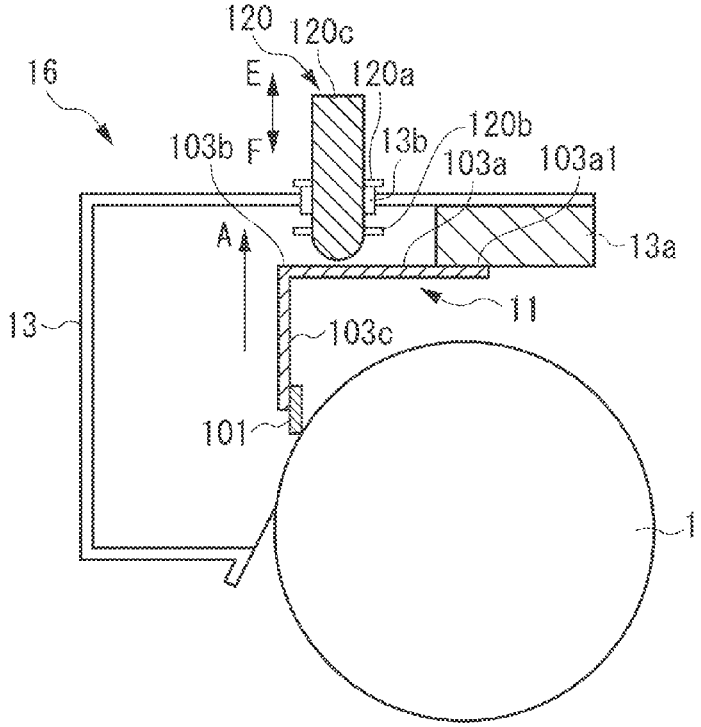
FIGS. 1A and 1B each schematically illustrate a configuration of a cleaning device according to a first exemplary embodiment of the present invention.
Figure 1B:
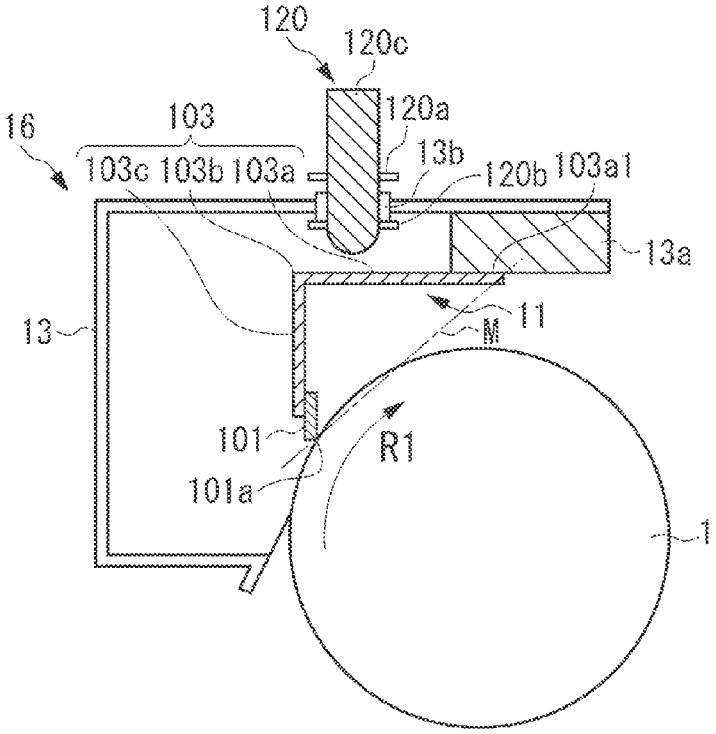

Next, the first exemplary embodiment of the present invention will be described in detail. FIGS. 1A and 1B illustrate the cleaning device 16 of the process cartridge 14 alone. FIG. 1A illustrates the state of the cleaning device 16 when the process cartridge 14 is detached from the apparatus main body M. FIG. 1B illustrates the state of the cleaning device 16 when the process cartridge 14 is attached to the apparatus main body M.

Referring to FIG. 1B, the cleaning member 11 includes a blade portion 101 configured to contact the photosensitive drum 1 in the counter direction relative to the movement direction R1 of the photosensitive drum 1, and a support member 103, which is a flexible spring made of a thin sheet metal. The blade portion 101 is provided at one end portion 103*c* of the support member 103. The support member 103 includes a fixed portion 103*a*1, which is provided at the other end portion 103*a* thereof, at which the support member 103 is fixed to a fixing portion 13*a* of the cleaning container 13. A stainless steel (SUS) material having a thickness of 0.2 mm is used as the support member 103.

The support member 103 includes a bent portion 103*b*, at which the support member 103 is bent, between the one end portion 103*c* and the other end portion 103*a*. The bent portion 103*b* is positioned outwardly away from the surface of the photosensitive drum 1 at the opposite side from the photosensitive drum 1 relative to a line segment M connecting a contacting portion 101*a*, where the blade portion 101 contacts the photosensitive drum 1, and the fixed portion 103*a*1. The distance from the fixed portion 103*a*1 to the bent portion 103*b* is 12 mm, and the distance from the bent portion 103*b* to the tip of the one end portion 103*c* is 10 mm.

In the present exemplary embodiment, the stainless steel (SUS) material is used as the support member 103, but the plate spring member may be any member having a spring characteristic, such as a phosphor-bronze plate. Further, in the present exemplary embodiment, the support member 103 is configured to include the single bent portion 103*b*, but is not limited thereto. The support member 103 may include a plurality of bent portions. Further, the support member 103 may be configured to be curved entirely.

Further, in the present exemplary embodiment, the blade portion 101 is made of a urethane rubber having Japanese Industrial Standards-A (JIS-A) hardness of 70 degrees, and a thickness of 0.6 mm. Further, generally, the blade portion 101 is fixed to the support member 103 by outsert-molding of the blade portion 101 on the support member 103. As other possible fixing methods, the blade portion 101 may be fixed to the support member 103 by using an adhesive agent or a double-faced tape.

The cleaning member 11 is configured in the above-described manner, whereby a contact pressure of the blade portion 101 is prevented from drastically increasing even when frictional force increases between the photosensitive drum 1 and the blade portion 101. Hereinafter, how this advantageous effect can be achieved will be described.

Figure 5:
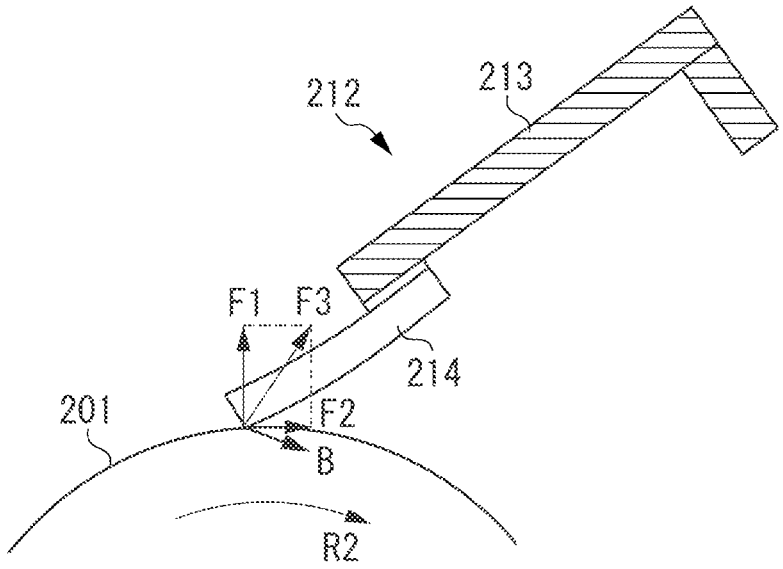
FIG. 5 illustrates how a cleaning member works according to a comparative example.

First, a cleaning member 212 will be described as a comparative example. FIG. 5 schematically illustrates a configuration of the cleaning member 212, which is a conventionally known technique, as the comparative example. A blade 214, which is made of a urethane rubber and is an elastic body, is supported by a rigid support member 213, and is configured to contact a photosensitive drum 201. Then, the elastic blade 214 is pressed (deformed) against the surface of the photosensitive drum 201, thereby acquiring the contact pressure for removing remaining toner from the surface of the photosensitive drum 201.

When the photosensitive drum 201 rotates in the direction indicated by the arrow R2, the blade 214 receives a resultant force F3, which is a total force of a reaction force F1, which is applied from the contact pressure of the blade 214, and a frictional force F2 between the surface of the photosensitive drum 201 and the blade 214. The resultant force F3 increases according to an increase in the frictional force F2. The blade 214 is comparatively less flexible in the direction of the resultant force F3. Therefore, the blade 214 is deformed in the direction indicated by the arrow B in FIG. 5.

The deformation occurs in the direction causing the blade 214 to be dug in the photosensitive drum 201, thereby increasing the strength of the reaction force F1. The increase in the strength of the reaction force F1 is followed by an increase in the strength of the frictional force F2. As a result, the reaction force F1 drastically increases. This may raise problems of an increase in driving torque for driving the photosensitive drum 1, and of curling up of the blade 214.

Figure 4A:
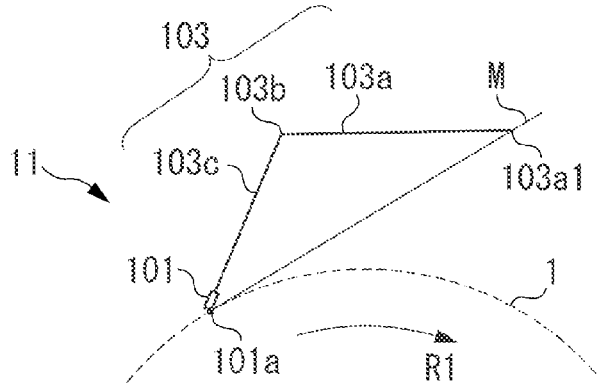
FIGS. 4A, 4B, and 4C each illustrate how a cleaning member works according to the exemplary embodiments of the present invention.

Next, how the cleaning member 11 according to the present exemplary embodiment works will be described with reference to FIGS. 4A to 4C. FIG. 4A is a model diagram illustrating how the flexible support member 103 is deformed when the frictional force increases between the surface of the photosensitive drum 1 and the blade portion 101.

The cleaning member 11 is pressed against the surface of the photosensitive drum 1 to deform the flexible support member 103, thereby acquiring the contact pressure for removing the remaining toner from the surface of the photosensitive drum 1.

When the photosensitive drum 1 rotates, the blade portion 101 receives a resultant force F3, which is a total force of a reaction force F1, which is applied from the contact pressure of the support member 103, and a frictional force F2 between the surface of the photosensitive drum 1 and the blade portion 101. Against the resultant force F3, the one end portion 103*c* is extremely less flexible for deformation and, therefore, difficult to be deformed since only a small angle is formed between the one end portion 103*c* and the resultant force F3.

On the other hand, the other end portion 103*a* is highly flexible in the direction of the resultant force F3 since a large angle is formed between the other end portion 103*a* and the resultant force F3. Therefore, the other end portion 103*a* can be deformed as indicated by the broken line in FIG. 4C. Then, the deformability of the other end portion 103*a* in the direction indicated by the arrow A in FIG. 4B can prevent the blade portion 101 supported by the support member 103 from being dug in the photosensitive drum 1. As a result, it is possible to reduce the increase in the reaction force F1, and prevent the increase in driving torque for driving the photosensitive drum 1 and the blade from being curled up.

Figure 4B:
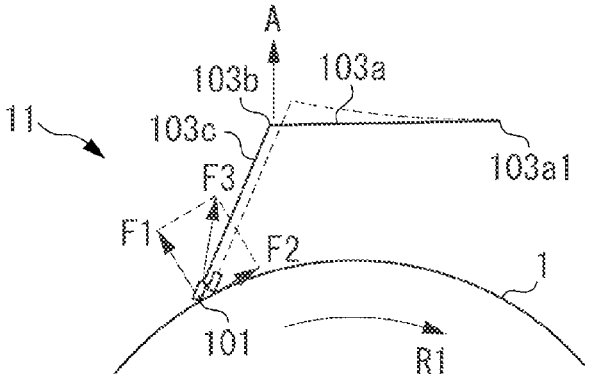
Figure 4C:
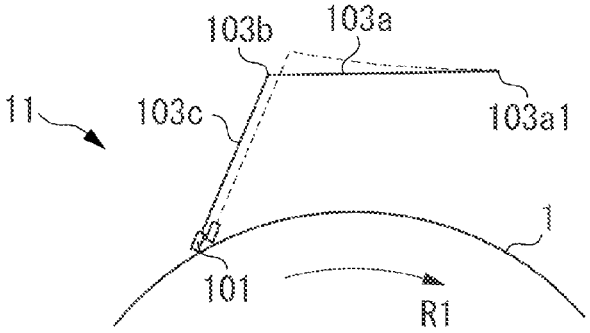

Further, it is important that the other end portion 103*a* can be elastically deformed by the resultant force F3 in the direction indicated by the arrow A in FIG. 4B. Therefore, the blade portion 101 is disposed to be supported only by the one end portion 103C in such a way as not to affect the bent portion 103*b*, thereby refrain from blocking the elastic deformation (bending) of the other end portion 103*a*.

However, as a result of employment of the above-described configuration, the support member 103 is configured to easily move in the direction indicated by the arrow A illustrated in FIG. 1A, compared to the cleaning member 212 in the comparative example illustrated in FIG. 5. Therefore, when the process cartridge 14 (the cleaning device 16) is detached from the apparatus main body M, and is hit against, for example, a desk to receive a strong vibration or impact, the support member 103 may be plastically deformed by being largely moved in the direction indicated by the arrow A illustrated in FIG. 1A.

The plastic deformation of the support member 103 results in a deviation of the contact pressure from the blade portion 101 to the photosensitive drum 1 from a predetermined value. As a result, the cleaning member 11 cannot sufficiently remove the toner remaining on the photosensitive drum 1, whereby the waste toner may leak out from the contacting portion between the blade portion 101 and the photosensitive drum 1.

Therefore, as illustrated in FIG. 1A, a restricting member 120 is disposed at the cleaning container 13 so as to restrict the support member 103 from moving in the direction indicated by the arrow A from above the other end portion 103*a* when the cartridge 14 is detached from the apparatus main body M.

The restricting member 120 is disposed so as to be slidable relative to the cleaning container 13 in the directions indicated by the arrows E and F. The restricting member 120 can be manually displaced between a restricting position illustrated in FIG. 1A and an allowing position illustrated in FIG. 1B.

In the restricting position illustrated in FIG. 1A, the contact of the restricting member 120 against the other end portion 103*a* restricts the support member 103 from moving in the direction indicated by the arrow A. Therefore, it is possible to restrict the support member 103 from largely moving in the direction indicated by the arrow A, thereby preventing the support member 103 from being plastically deformed, when the process cartridge 14 receives an impact.

Further, when the process cartridge 14 is attached to the apparatus main body M, the restricting member 120 is displaced to the allowing position illustrated in FIG. 1B, thereby ensuring that there is enough space to allow the other end portion 103*a* to be deflected when the support member 103 receives a force from the photosensitive drum 1.

Further, in the restricting position illustrated in FIG. 1A, the restricting member 120 is arranged in such a manner that some space is provided between the restricting member 120 and the other end portion 103*a* so as to avoid continuous application of the force from the restricting member 120 to the other end portion 103*a*.

Further, a sealing member 13*b* is disposed between the cleaning container 13 and the restricting member 120 so as to prevent the toner from leaking from therebetween. The restricting member 120 includes a cylindrical base 120*c*, and position regulating portions 120*a* and 120*b*, which are circular flanges disposed around the cylindrical base 120*c*.

The position regulating portions 120*a* and 120*b* regulate a displacement amount of the restricting member 120 in the direction indicated by the arrow E and the direction indicated by the arrow F. The position regulating portions 120*a* and 120*b* serve to determine the restricting position and the allowing position of the restricting member 120.

Further, the restricting member 120 can be made of a material having a large frictional coefficient for the friction between the restricting member 102 and the sealing member 13*b*. This is because, even when the restricting member 120 receives a force from the support member 103 at the restricting position, the frictional force allows the restricting member 120 to keep the same state without being displaced in the direction indicated by the arrow E.

Further, similarly, in the allowing position, the restricting member 120 can also keep the state not being displaced in the direction indicated by arrow F. The restricting member 120 may include a material constituted by an elastic body such as a rubber.

Further, a pin, which radially penetrates the base 120*c* of the restricting member 120, may be provided to engage with a cam or a hook provided at the cleaning container 13 to further secure the positioning of the restricting position and the allowing position of the restricting member 120.

Next, a second exemplary embodiment of the present invention will be described with reference to FIGS. 2A to 2C, 3, and 7. The first exemplary embodiment is described based on the configuration in which the restricting member 120 is manually attached when the process cartridge 14 is detached from the apparatus main body M. However, as illustrated in FIGS. 3 and 7, a restricting member 320 may be configured to be displaced to engage with a support member 303 by interlocking with detachment of a cartridge 314 from the apparatus main body M, for the purpose of improving the usability.

More specifically, the restricting member 320 is rotatably supported by a cleaning container 313. When the cartridge 314 is detached from the apparatus main body M, as illustrated in FIG. 3, the restricting member 320 rotates by being biased in the direction indicated by the arrow D by a spring (not illustrated) disposed at the cleaning container 313.

Then, an engaging portion 320*a* of the restricting member 320 engages with a hole 321, which is an engaged portion provided at the support member 303. As a result, it becomes possible to restrict the support member 303 from largely moving in the direction indicated by the arrow A, thereby preventing the support member 303 from being plastically deformed, when the process cartridge 314 receives an impact, in a similar manner to the first exemplary embodiment. The position of the restricting member 320 at this time corresponds to the restricting position.

Figure 7:
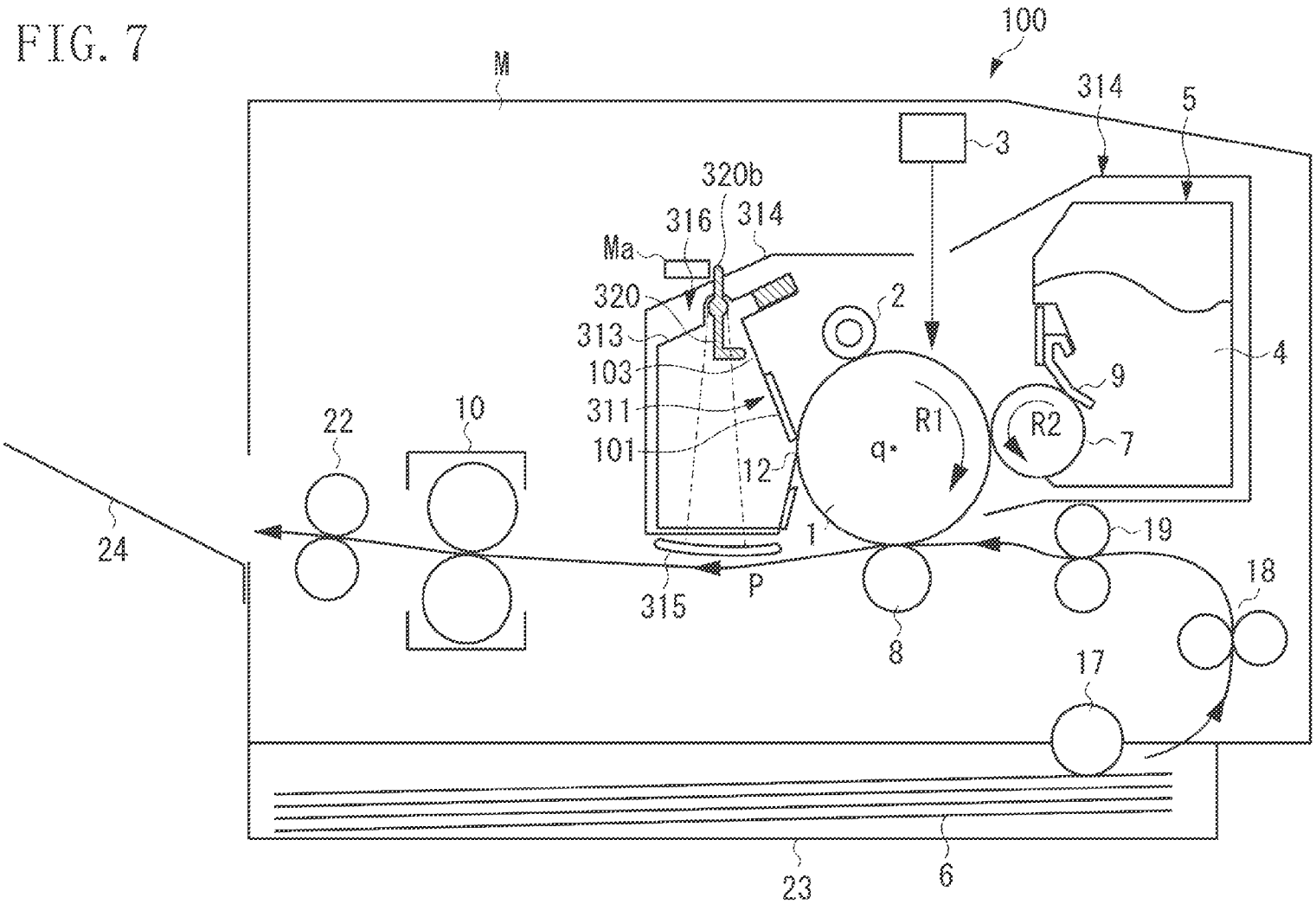
FIG. 7 schematically illustrates a configuration of an image forming apparatus according to the second exemplary embodiment of the present invention.

Further, when the cartridge 314 is attached to the apparatus main body M, as illustrated in FIG. 7, a contacted portion 320*b* of the restricting member 320 contacts a contacting portion Ma disposed at the apparatus main body M. As a result, the restricting member 320 rotates in the direction indicated by the arrow C (refer to FIG. 3), thereby disengaging the engaging portion 320*a* from an end portion 303*c* of the support member 303.

This allows the other end portion 303*a* to be elastically deformed by application of a force from the photosensitive drum 1 to the support member 303, in a similar manner to the first exemplary embodiment. The position of the restricting member 320 at this time corresponds to the allowing position.

Figure 2A:
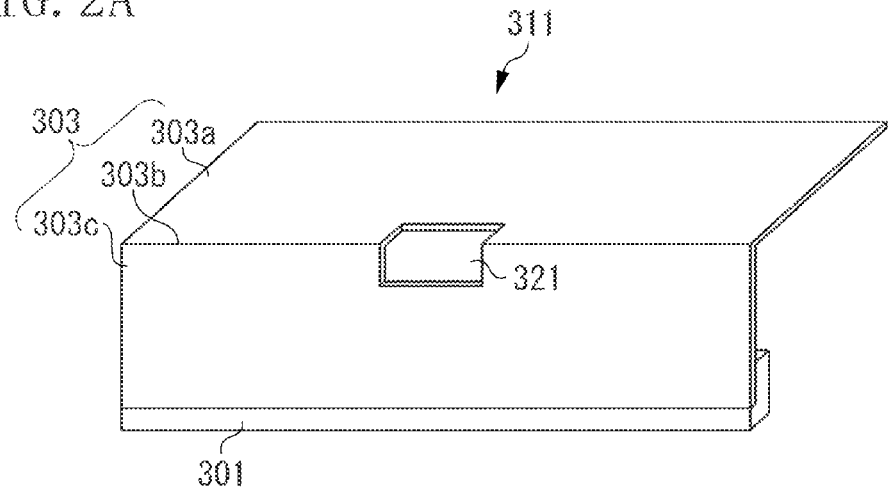
FIGS. 2A, 2B, and 2C each schematically illustrate a configuration of a support member of a cleaning blade according to a second exemplary embodiment of the present invention.
Figure 2B:
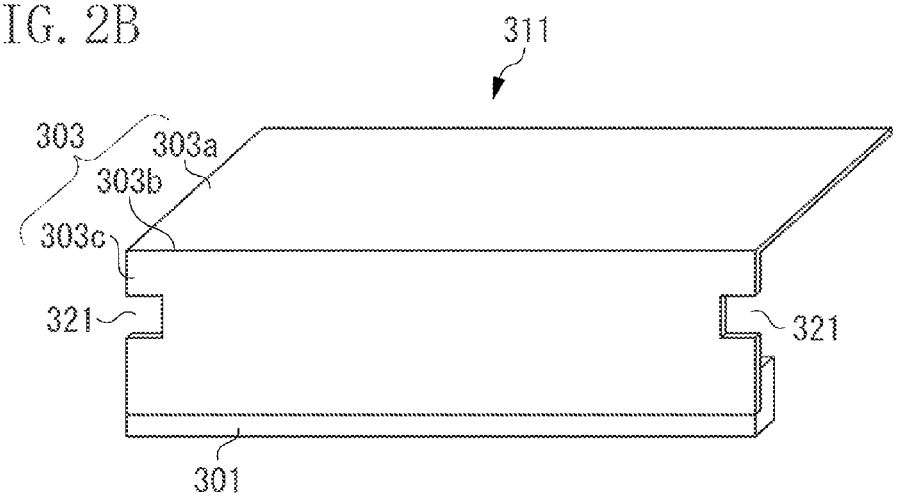
Figure 2C:
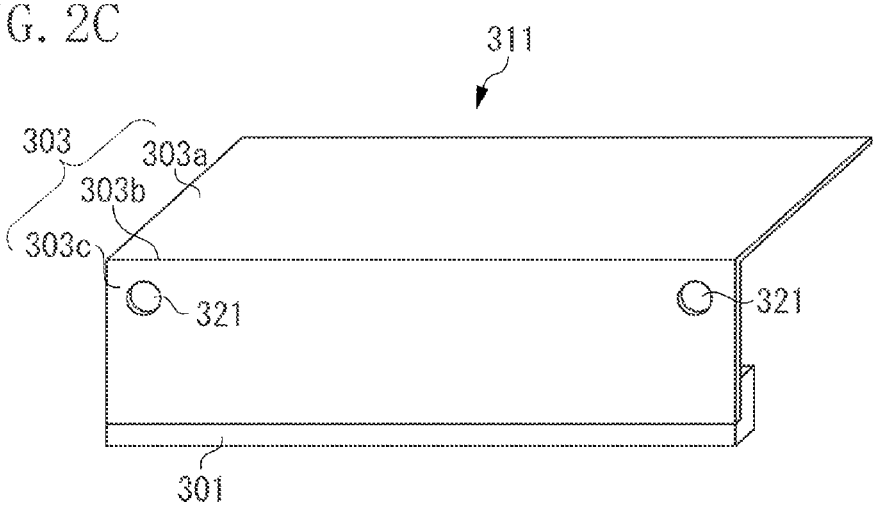
Figure 3:
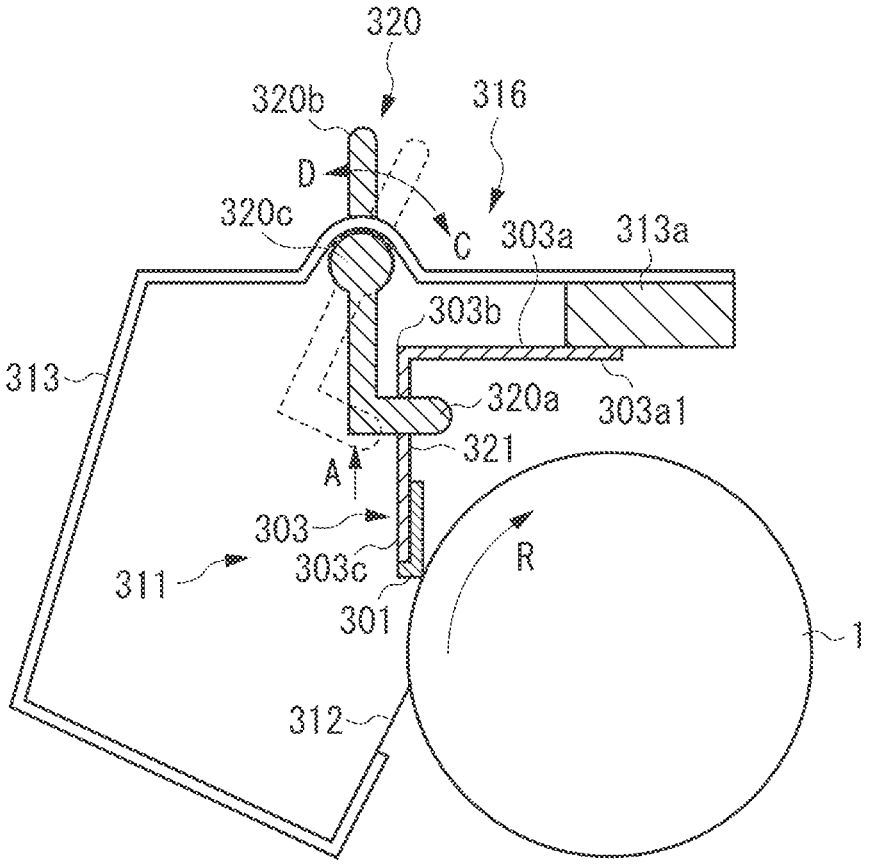
FIG. 3 schematically illustrates a configuration of a cleaning device according to the second exemplary embodiment of the present invention.

The engaged portion provided at the support member 303 can be shaped as illustrated in FIGS. 2A, 2B, and 2C. The engaged portion illustrated in FIG. 2A includes a single hole at the center of the one end portion 303*c* in the longitudinal direction. The engaged portion illustrated in FIG. 2B includes two cutouts at the opposing ends of the one end portion 303*c* in the longitudinal direction. The engaged portion illustrated in FIG. 2C includes two circular holes at the opposing ends of the one end portion 303*c* in the longitudinal direction. The engaging portion 320*a* engages with the holes or cutouts.

As illustrated in FIG. 7, the process cartridge 314 is configured so that the restricting member 320 interlocks with a drum shutter 315 for protecting the surface of the photosensitive drum 1. In other words, the contacted portion 320*b* also functions to displace the drum shutter 315, thereby enabling miniaturization of the process cartridge 314.

In this way, the second exemplary embodiment has been described, mainly focusing on differences from the first exemplary embodiment. The features that have not been described above are similar to the first exemplary embodiment.

In this way, according to the above-described exemplary embodiments of the present invention, in the cleaning device, which includes the cleaning member having the flexible support member, and the process cartridge, it is possible to prevent the support member from being deformed when the cleaning device and the process cartridge are detached from the main body of the image forming apparatus.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2011-237520 filed Oct. 28, 2011, and No. 2012-193265 filed Sep. 3, 2012, which are hereby incorporated by reference herein in their entirety.

What is claimed is:

1. A cleaning device detachably attached to a main body of an image forming apparatus, the cleaning device comprising:

a fixing portion provided at a frame member;

a cleaning member fixed to the fixing portion for removing developer from an image bearing member, the cleaning member including a blade portion configured to contact the image bearing member, and a flexible support member for supporting the blade portion;

a container formed by the frame member and configured to contain the developer removed from the image bearing member; and a restricting member configured to engage with the support member and being capable of restricting the support member from being deformed, wherein the restricting member is displaceable to a restricting position, in which the restricting member restricts the support member from being deformed when the cleaning device is detached from the main body of the image forming apparatus, and to an allowing position, in which the restricting member allows the support member to be deformed when the cleaning device is attached to the main body of the image forming apparatus.

2. The cleaning device according to claim 1, wherein the blade portion is configured to contact the image bearing member in a counter direction relative to a movement direction of the image bearing member, and wherein the support member includes one end portion on which the blade portion is disposed, the other end portion including a fixed portion fixed to the fixing portion, and a bent portion which is positioned between the one end portion and the other end portion outwardly away from a surface of the image bearing member relative to a line segment connecting a contacting portion where the blade portion contacts the image bearing member to the fixed portion.

3. The cleaning device according to claim 2, wherein the restricting member is configured to engage with the one end portion to restrict the support member from being deformed.

4. The cleaning device according to claim 2, wherein the restricting member is configured to engage with the other end portion to restrict the support member from being deformed.

5. The cleaning device according to claim 1, wherein the restricting member includes a contacted portion configured to contact the main body of the image forming apparatus and to displace the restricting member from the restricting position to the allowing position when the cleaning device is attached to the main body of the image forming apparatus.

6. The cleaning device according to claim 1, wherein the restricting member is elastic.

7. The cleaning device according to claim 1, wherein the restricting member is rotatably supported by the container.

8. The cleaning device according to claim 1, wherein the flexible support member has a hole or a cutout for engaging with the restricting member.

9. The cleaning device according to claim 1, wherein the support member is a spring.

10. The cleaning device according to claim 1, wherein the support member is sheet metal.

11. A process cartridge detachably attached to a main body of an image forming apparatus, the process cartridge comprising:

an image bearing member;

a fixing portion provided at a frame member;

a cleaning member fixed to the fixing portion for removing developer from the image bearing member, the cleaning member including a blade portion configured to contact the image bearing member, and a flexible support member for supporting the blade portion;

a container formed by the frame member and configured to contain the developer removed from the image bearing member; and a restricting member configured to engage with the support member and being capable of restricting the support member from being deformed, wherein the restricting member is displaceable to a restricting position, in which the restricting member restricts the support member from being deformed when the process cartridge is detached from the main body of the image forming apparatus, and to an allowing position, in which the restricting member allows the support member to be deformed when the process cartridge is attached to the main body of the image forming apparatus.

12. The process cartridge according to claim 11, wherein the blade portion is configured to contact the image bearing member in a counter direction relative to a movement direction of the image bearing member, and wherein the support member includes one end portion on which the blade portion is disposed, the other end portion including a fixed portion which is fixed to the fixing portion, and a bent portion positioned between the one end portion and the other end portion outwardly away from a surface of the image bearing member relative to a line segment connecting a contacting portion, where the blade portion contacts the image bearing member, to the fixed portion.

13. The process cartridge according to claim 12, wherein the restricting member is configured to engage with the one end portion to restrict the support member from being deformed.

14. The process cartridge according to claim 12, wherein the restricting member is configured to engage with the other end portion to restrict the support member from being deformed.

15. The process cartridge according to claim 11, wherein the restricting member includes a contacted portion configured to contact the main body of the image forming apparatus and to displace the restricting member from the restricting position to the allowing position when the process cartridge is attached to the main body of the image forming apparatus.

16. The process cartridge according to claim 11, wherein the restricting member is elastic.

17. The process cartridge according to claim 11, wherein the restricting member is rotatably supported by the container.

18. The process cartridge according to claim 11, wherein the flexible support member has a hole or a cutout for engaging with the restricting member.

19. The process cartridge according to claim 11, wherein the support member is a spring.

20. The process cartridge according to claim 11, wherein the support member is sheet metal.

* * * * *